US009063512B2

(12) United States Patent
Koshida

(10) Patent No.: US 9,063,512 B2
(45) Date of Patent: Jun. 23, 2015

(54) IMAGE FORMING APPARATUS HAVING DETACHABLE BELT UNIT

(71) Applicant: CANON KABUSHIKI KAISHA, Tokyo (JP)

(72) Inventor: Kohei Koshida, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/138,423

(22) Filed: Dec. 23, 2013

(65) Prior Publication Data

US 2014/0178099 A1 Jun. 26, 2014

(30) Foreign Application Priority Data

Dec. 25, 2012 (JP) ..... 2012-281068

(51) Int. Cl.
*G03G 21/16* (2006.01)

(52) U.S. Cl.
CPC ..... *G03G 21/1619* (2013.01); *G03G 21/168* (2013.01); *G03G 2215/0132* (2013.01)

(58) Field of Classification Search
CPC ..... G03G 15/01; G03G 15/161; G03G 21/16; G03G 21/168; G03G 2221/16; G03G 2221/1642; G03G 2221/1603; G03G 21/1619; G03G 2215/0132
USPC ..... 399/121, 107, 110
See application file for complete search history.

(56) References Cited

U.S. PATENT DOCUMENTS

2008/0253804 A1* 10/2008 Furuta et al. ..... 399/121 X
2010/0086320 A1* 4/2010 Koizumi et al. ..... 399/30
2010/0329738 A1 12/2010 Shirai

FOREIGN PATENT DOCUMENTS

JP 2006-259458 A 9/2006
JP 2011-013305 A 1/2011
JP 2011-191626 A * 9/2011

OTHER PUBLICATIONS

U.S. Appl. No. 14/138,365, filed Dec. 23, 2013, Kohei Koshida.

* cited by examiner

*Primary Examiner* — Sophia S Chen
(74) *Attorney, Agent, or Firm* — Fitzpatrick, Cella, Harper & Scinto

(57) ABSTRACT

An image forming apparatus includes a main assembly, a belt unit detachably mountable to the main assembly, and image forming portions, provided below the belt unit and forming toner images on the belt member. Toner cartridges, provided above the belt unit, supply toners to the image forming portions, and a side plate is provided in the main assembly. In addition, an integrated member is provided on the side plate and includes a guiding member having a guiding portion for guiding the belt unit and toner supply passages for permitting communication of the image forming portions with the toner cartridges, respectively. The guiding member and the toner supply passages are integrally constituted so that the toner supply passages penetrate the guiding member.

15 Claims, 13 Drawing Sheets

(a)

(b)

IMAGE FORMING APPARATUS HAVING DETACHABLE BELT UNIT

FIELD OF THE INVENTION AND RELATED ART

The present invention relates to an image forming apparatus from which a belt unit is pullable.

In Japanese Laid-Open Patent Application (JP-A) 2006-259458, a so-called tandem type image forming apparatus in which a plurality of toner images formed at a plurality of image forming portions are transferred onto a recording material by using a belt member (intermediary transfer belt or recording material conveying belt) has been widely used. In the image forming apparatus including the plurality of image forming portions, in order to independently supply toners to the plurality of image forming portions, a plurality of toner supply passages are provided.

In JP-A 2011-13305, in an image forming apparatus using a belt member, in a state in which the belt member is stretched by a plurality of rotatable supporting members, a belt unit which can be exchanged as a unit is detachably provided in a casing of the image forming apparatus.

As shown in JP-A 2006-259458, in the case where a belt unit is provided between the plurality of toner supply portions and the plurality of image forming portions, there is a need to provide the plurality of toner supply passages for permitting individual communication of the plurality of toner supply portions with the plurality of image forming portions. Further, it order to make the individual image forming portions pullable in a longitudinal direction (rotational axis direction of image bearing members) while avoiding interference with the belt unit, there is a need to fix the toner supply passages, to the casing of the image forming apparatus, as parts separate from the image forming portions.

Therefore, individual fixing of resin-molded products of the toner supply passages on a partition wall member formed with a steel plate for partitioning a space in which the plurality of image forming portions in the casing were provided was proposed. However, in this case, many screw connection parts are required for individually positioning and fixing the plurality of the resin-molded products, and during manufacturing, there is a need for individually positionally adjusting and assembling the plurality of the resin-molded products.

As shown in JP-A 2011-13305, in the case where the belt unit is made pullable in a direction along the plurality of image forming portions, on the partition wall member formed with the steel plate for partitioning the space in which the plurality of image forming portions in the casing are disposed, there is a need to provide a guiding member for pulling out the belt unit. However, when a continuous guiding structure is provided along the plurality of image forming portions, the guiding structure crosses the toner supply passages for permitting communication of the toner supply portions with the image forming portions, and therefore constitutes an obstacle to disposition of the toner supply passages.

SUMMARY OF THE INVENTION

According to an aspect of the present invention, there is provided an image forming apparatus comprising: a main assembly; a belt unit, including a belt member and a plurality of supporting rollers for supporting the belt member, detachably mountable to the main assembly with respect to a direction crossing a rotational axis direction of the supporting rollers; a plurality of image forming portions, provided below the belt unit along the belt member, for forming toner images on the belt member; a plurality of toner cartridges, provided above the belt unit, for supplying toners to the plurality of image forming portions, respectively; a side plate provided in the main assembly; and an integrated member provided on the side plate and including a guiding member having a guiding portion for guiding the belt unit and a plurality of toner supply passages for permitting communication of the image forming portions with the toner cartridges associated with the image forming portions, respectively, wherein the guiding member and the toner supply passages are integrally constituted so that the toner supply passages penetrate the guiding member.

These and other objects, features and advantages of the present invention will become more apparent upon a consideration of the following description of the preferred embodiments of the present invention taken in conjunction with the accompanying drawings.

Figure 2:
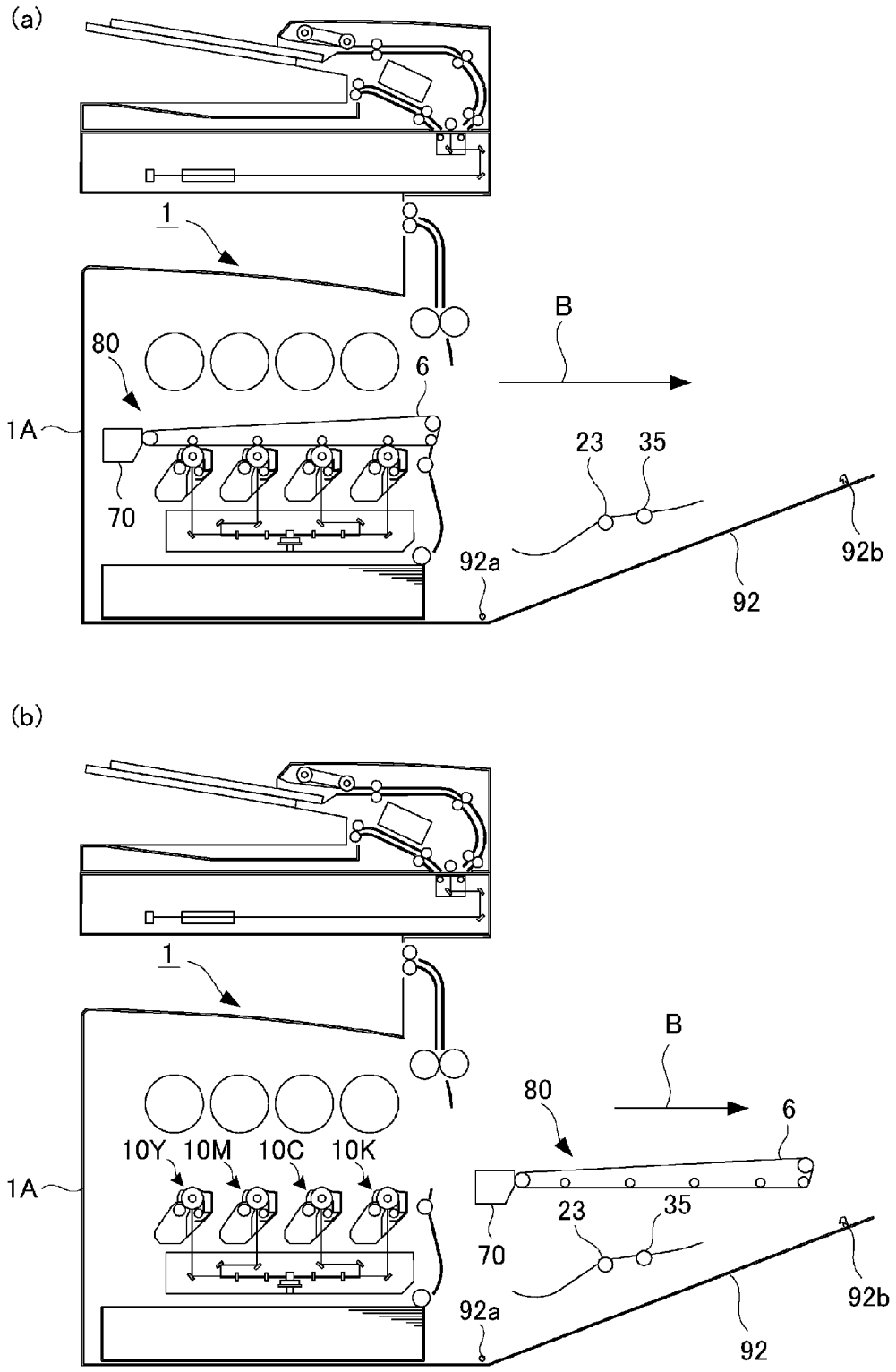

Parts (a) and (b) of FIG. 2 are schematic views for illustrating demounting and mounting of an intermediary transfer unit with respect to the image forming apparatus.

Figure 3:
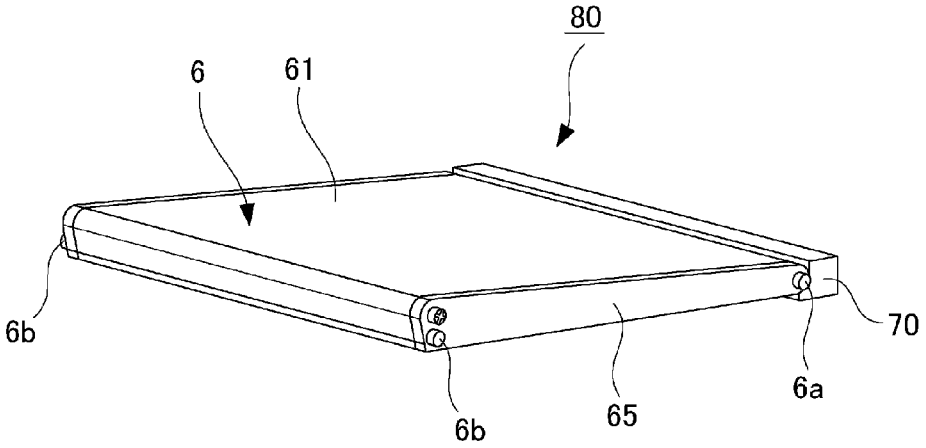

FIG. 3 is a perspective view of the intermediary transfer unit.

Figure 4:
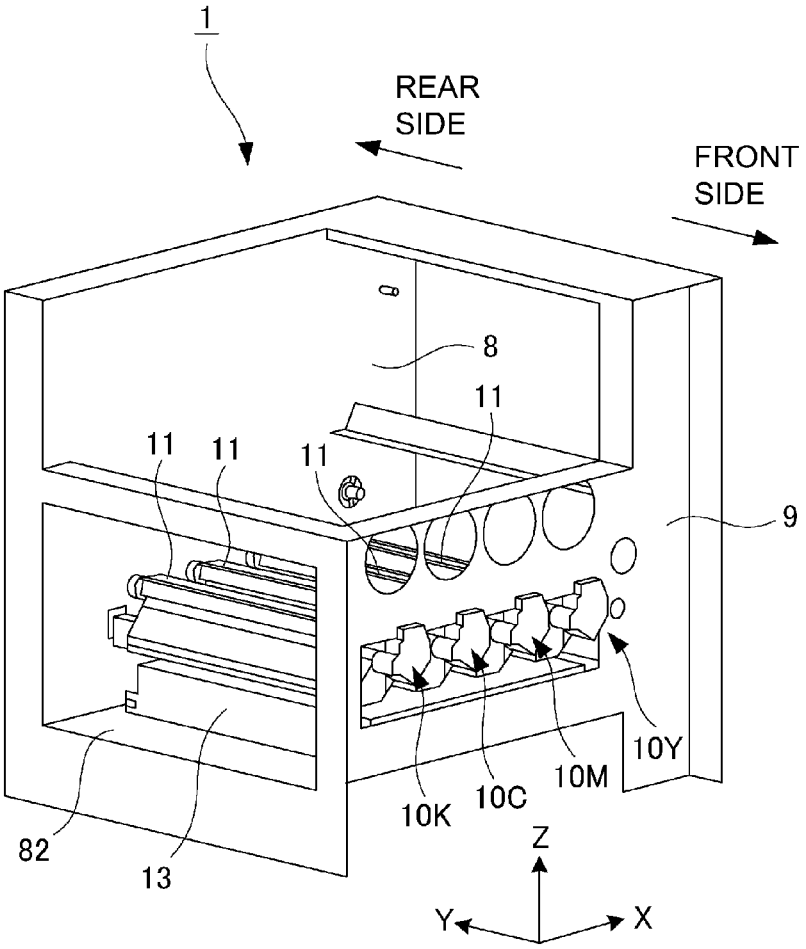

FIG. 4 is an illustration of an inside structure of a casing of the image forming apparatus as seen from a front surface side.

Figure 5:
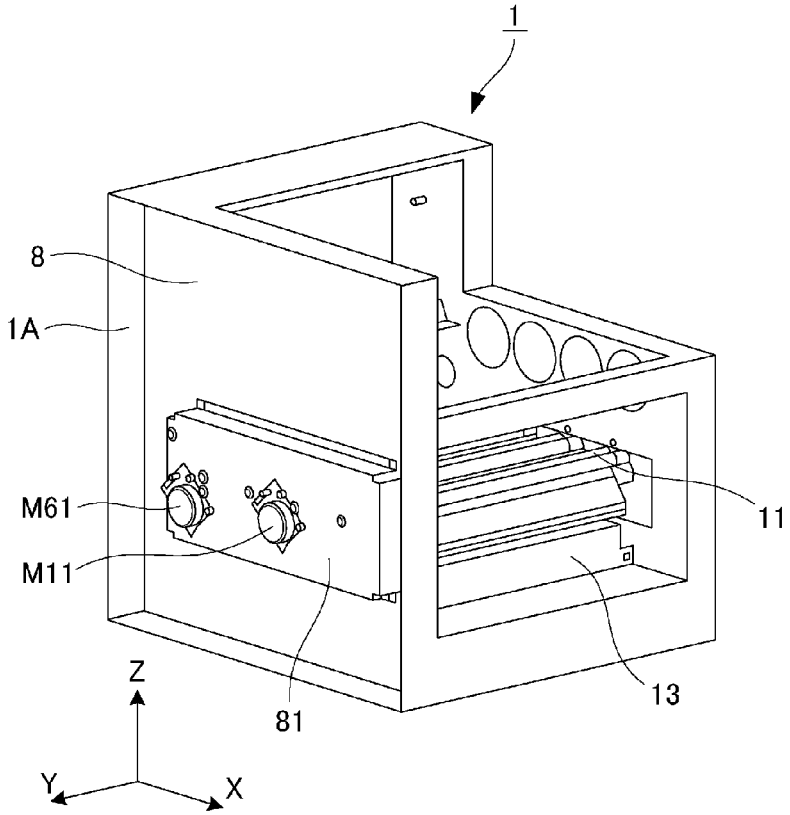

FIG. 5 is an illustration of the inside structure of the casing of the image forming apparatus as seen from a rear surface side.

Figure 6:
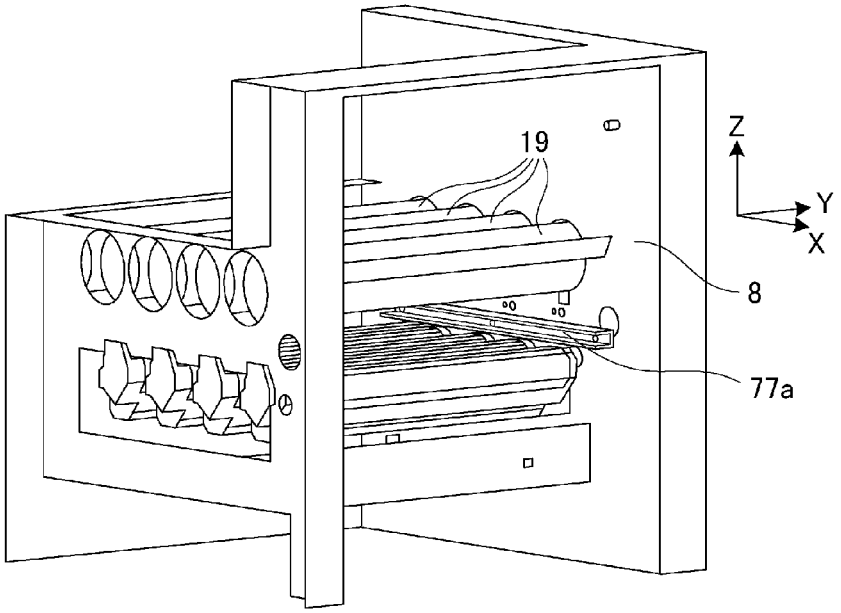

FIG. 6 is an illustration of an arrangement of a guiding member in a Comparison example.

Figure 7:
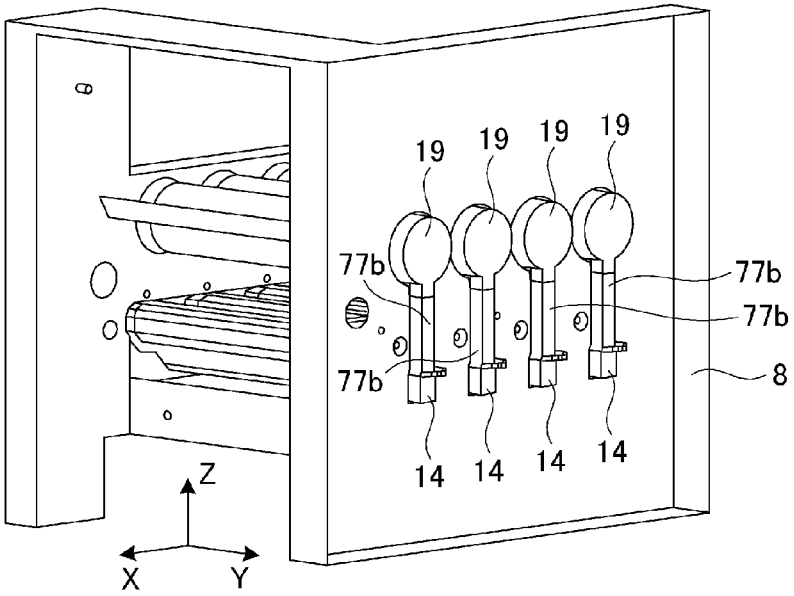

FIG. 7 is an illustration of an arrangement of toner supply passages in the Comparison example.

Figure 8:
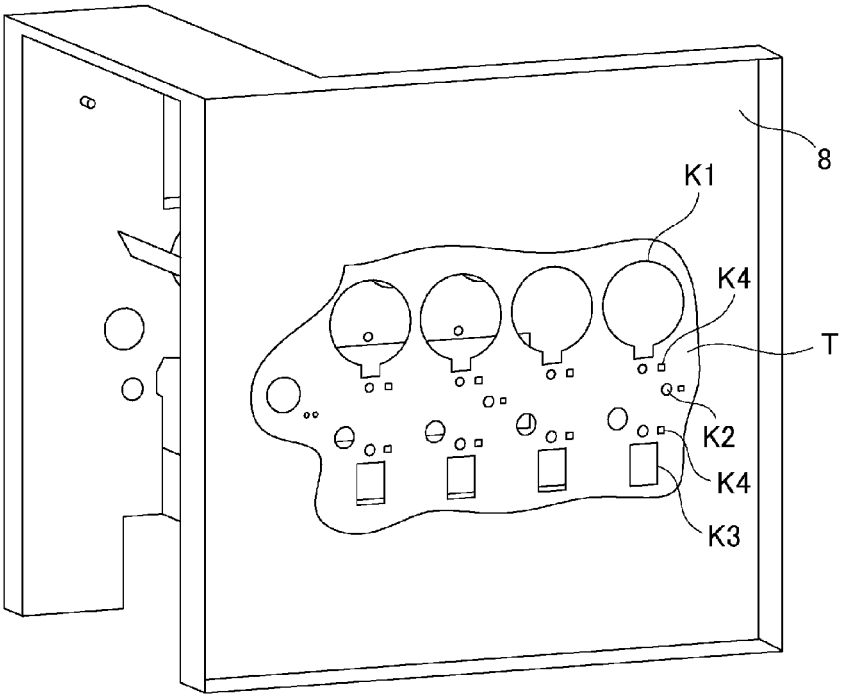

FIG. 8 is a schematic view for illustrating the number of openings of a partition wall in the Comparison example.

Figure 9:
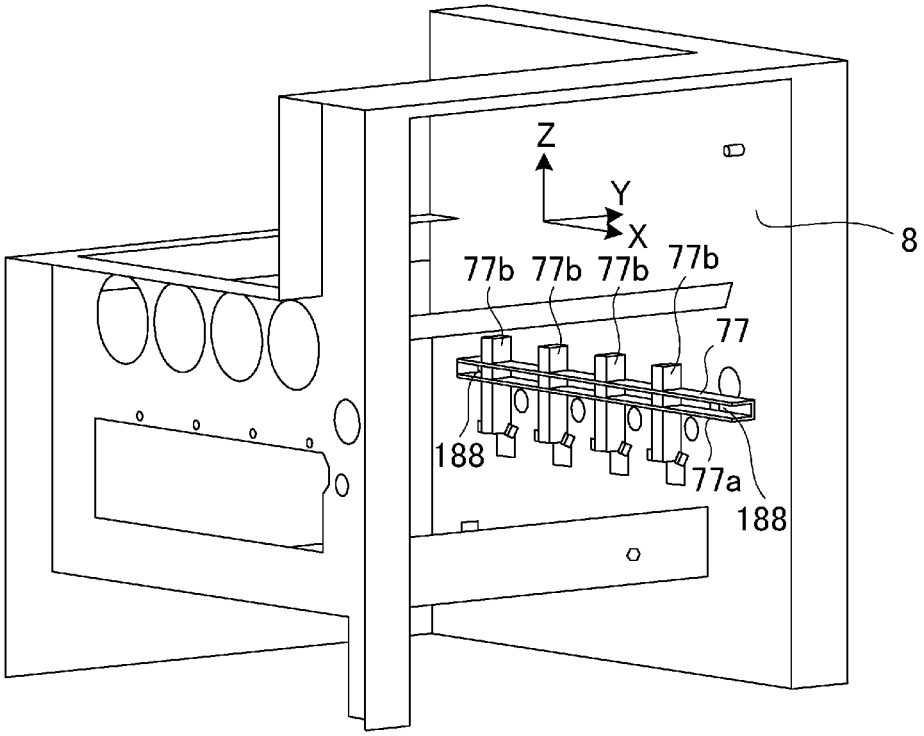

FIG. 9 is an illustration of a structure of the image forming apparatus in Embodiment 1.

Figure 10:
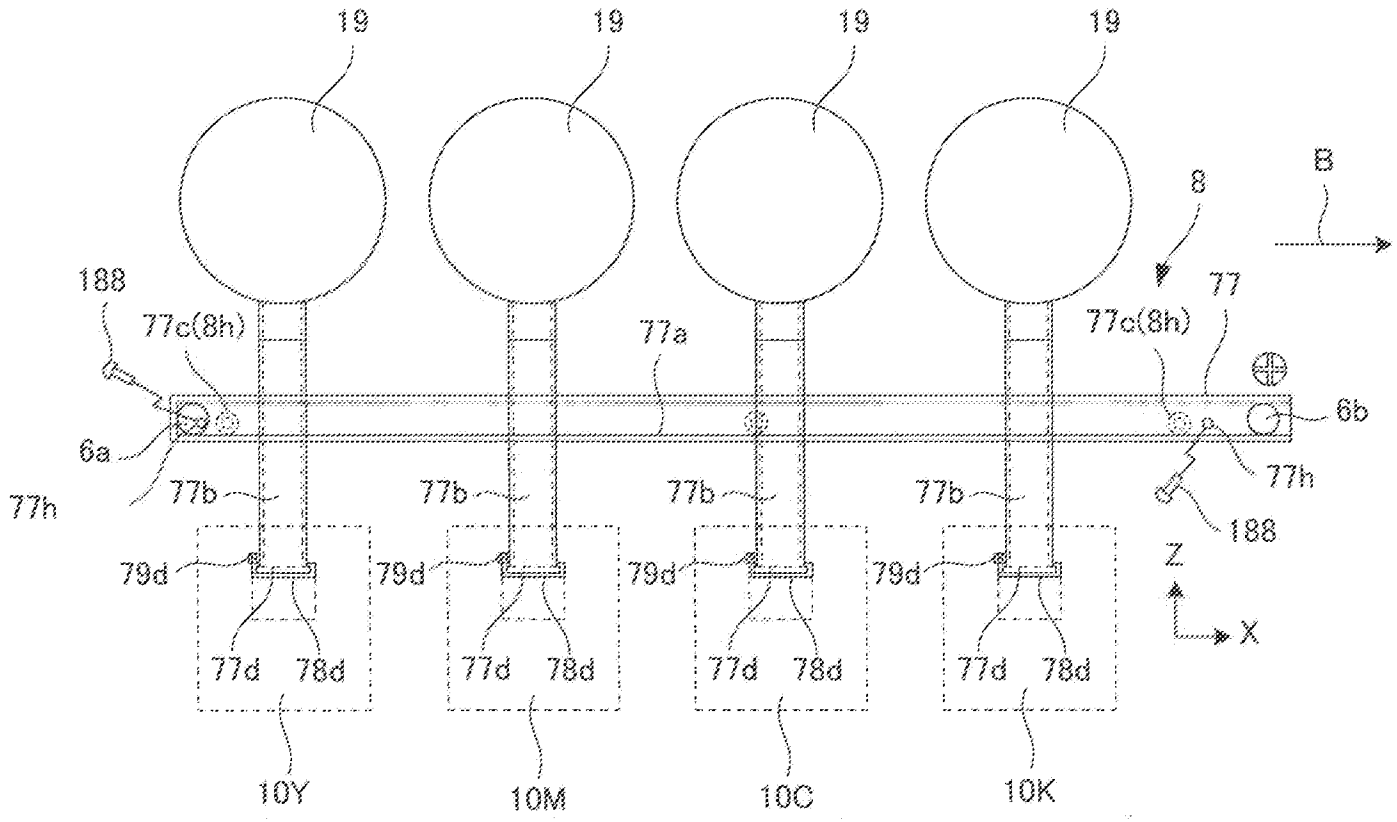

FIG. 10 is an illustration of an arrangement of an assembled structure of an integrated member.

Figure 11:
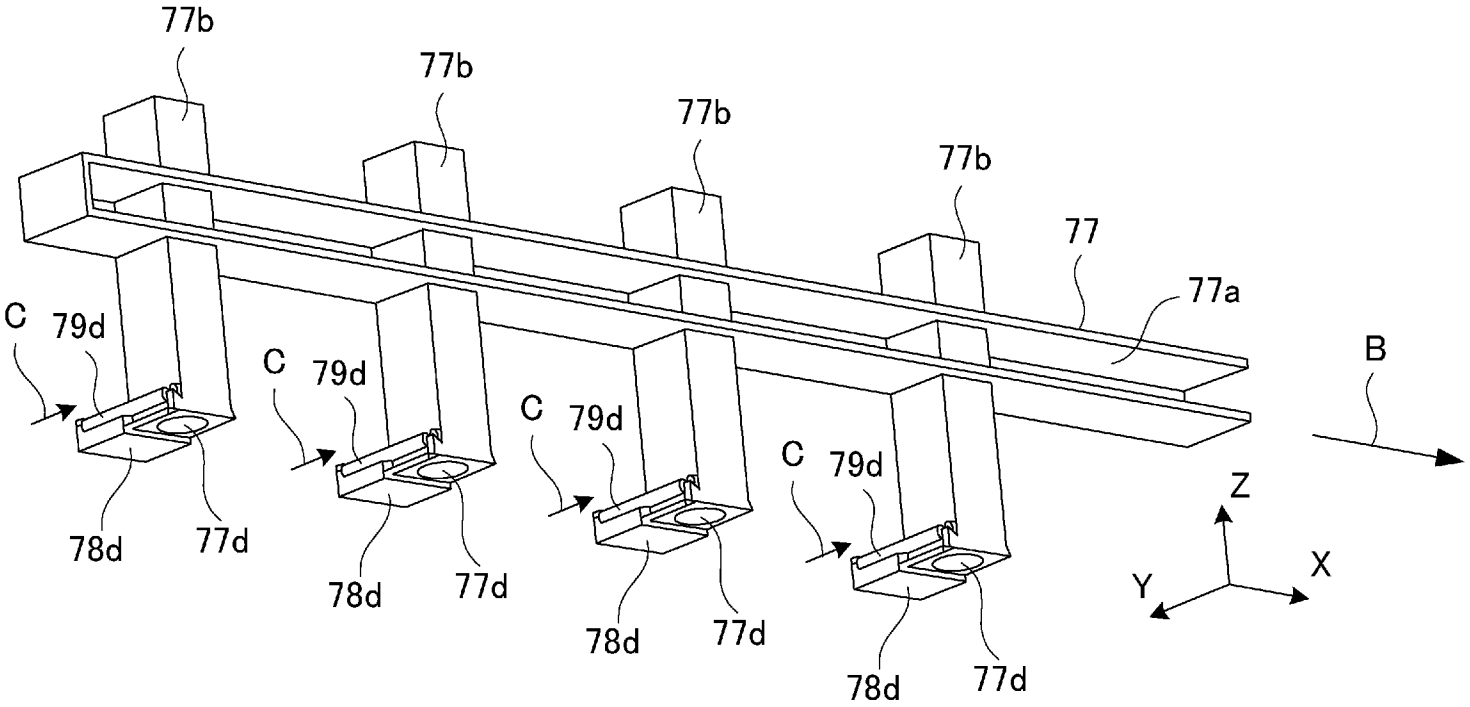

FIG. 11 is a perspective view of the integrated member.

Figure 12:
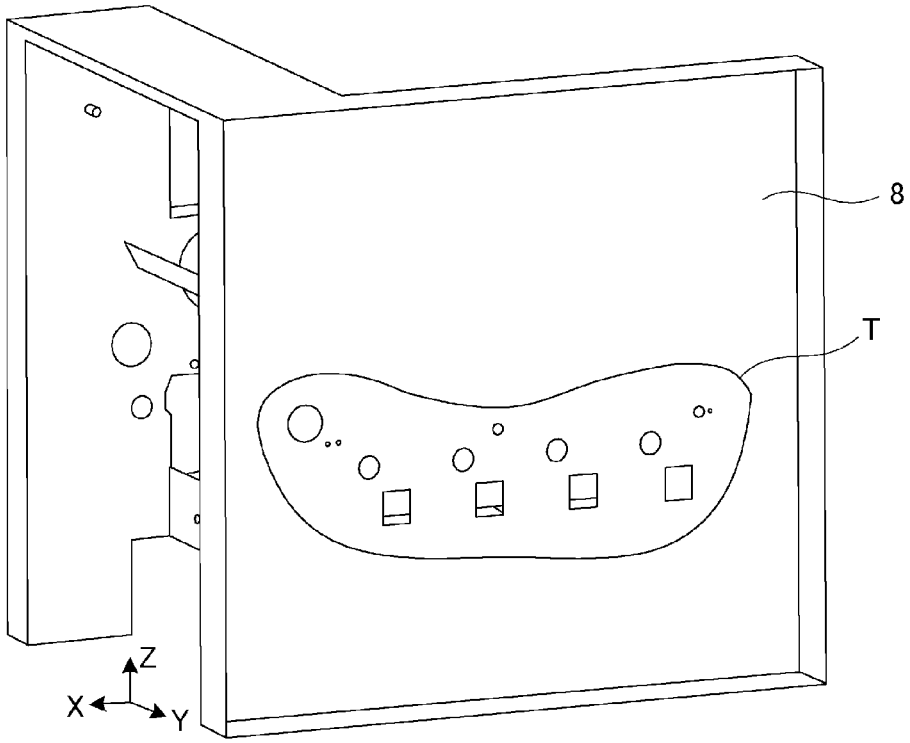

FIG. 12 is a schematic view for illustrating the number of openings of a partition wall in Embodiment 1.

Figure 13:
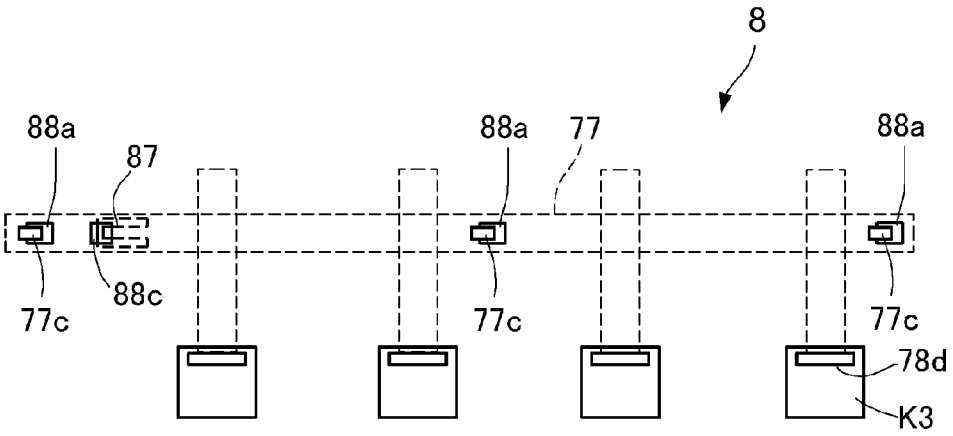

FIG. 13 is an illustration of an assembled state of an integrated member in Embodiment 2.

Figure 14:
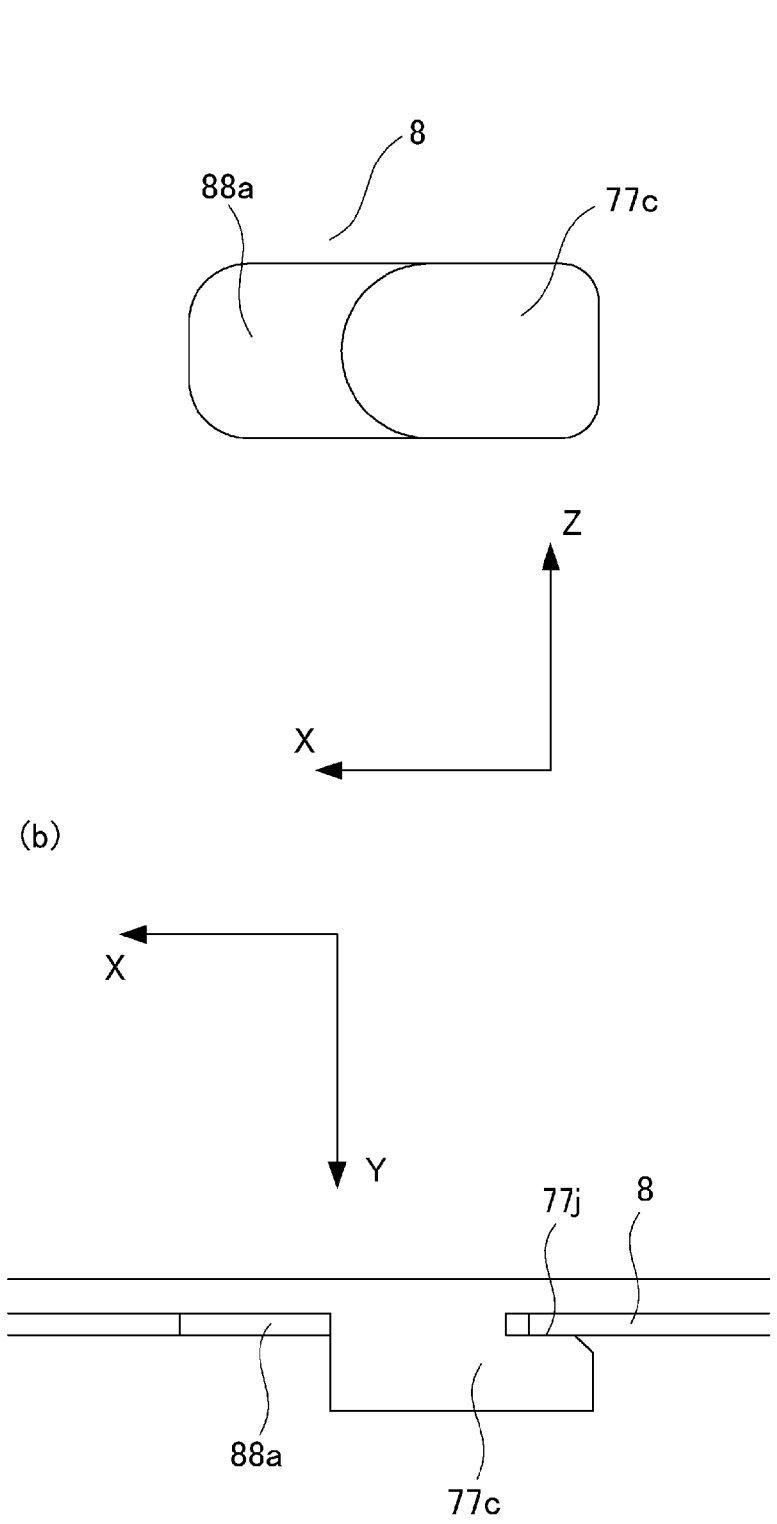

Parts (a) and (b) of FIG. 14 are schematic views for illustrating a relationship between a mounting portion and a positioning opening.

Figure 15:
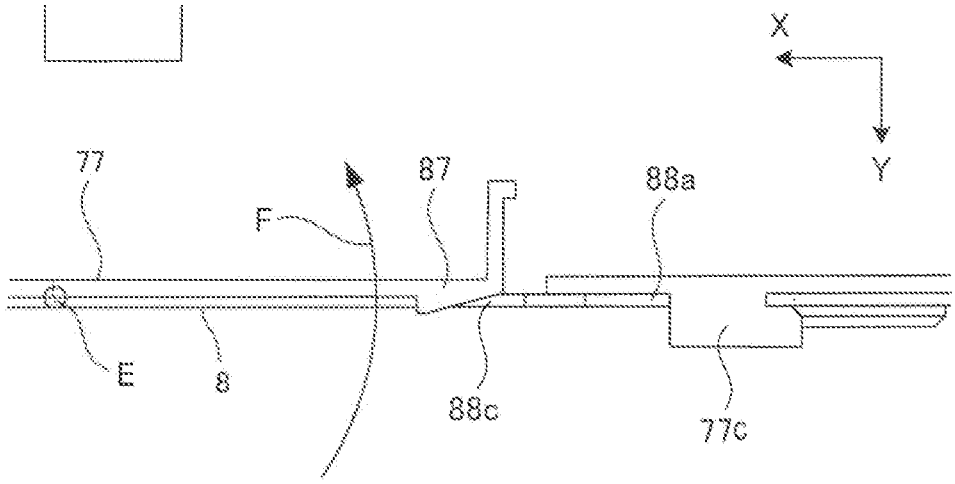

FIG. 15 is a schematic view for illustrating a relationship between a hook portion and the positioning opening.

Figure 16:
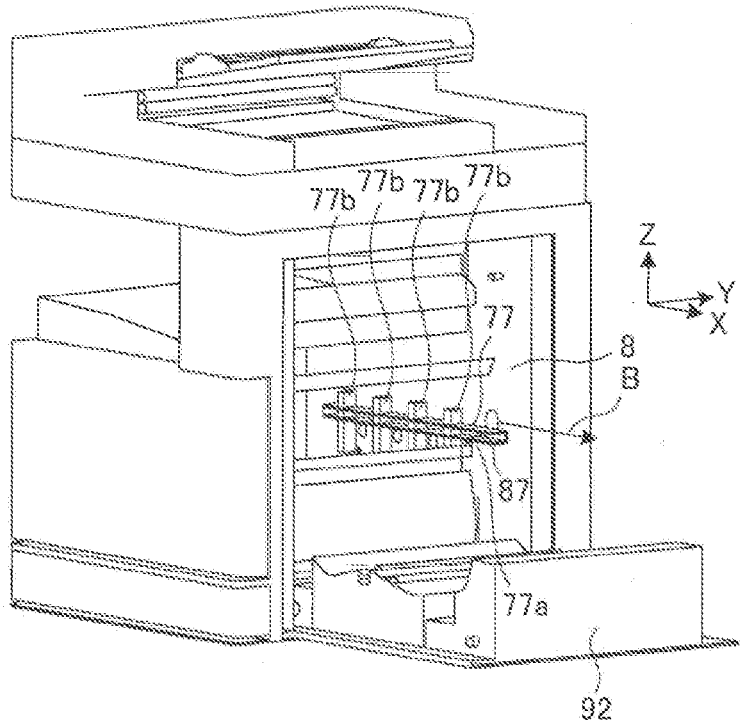
Figure 16:
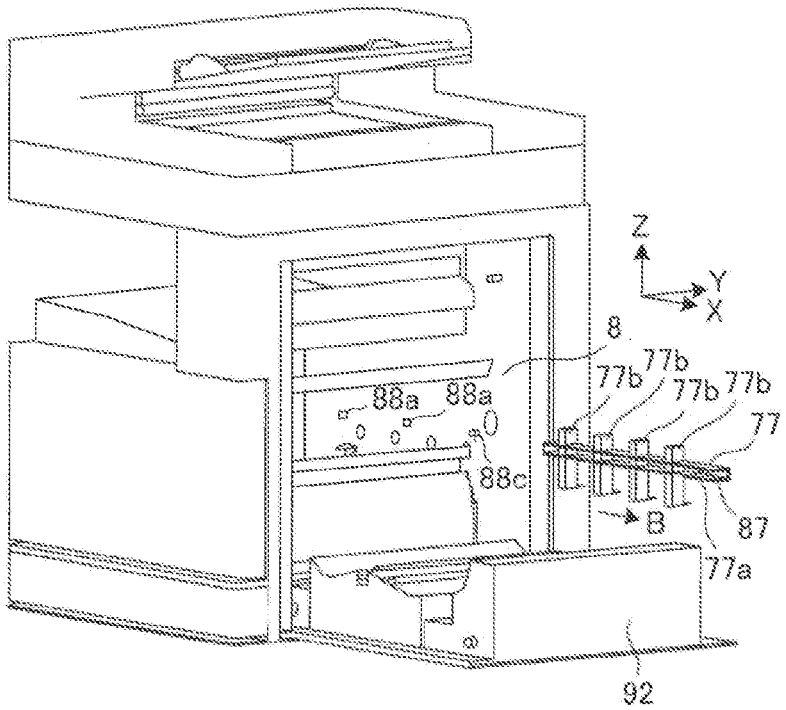

Parts (a) and (b) of FIG. 16 are schematic views for illustrating a demounting and mounting method of an integrated member.

Figure 17:
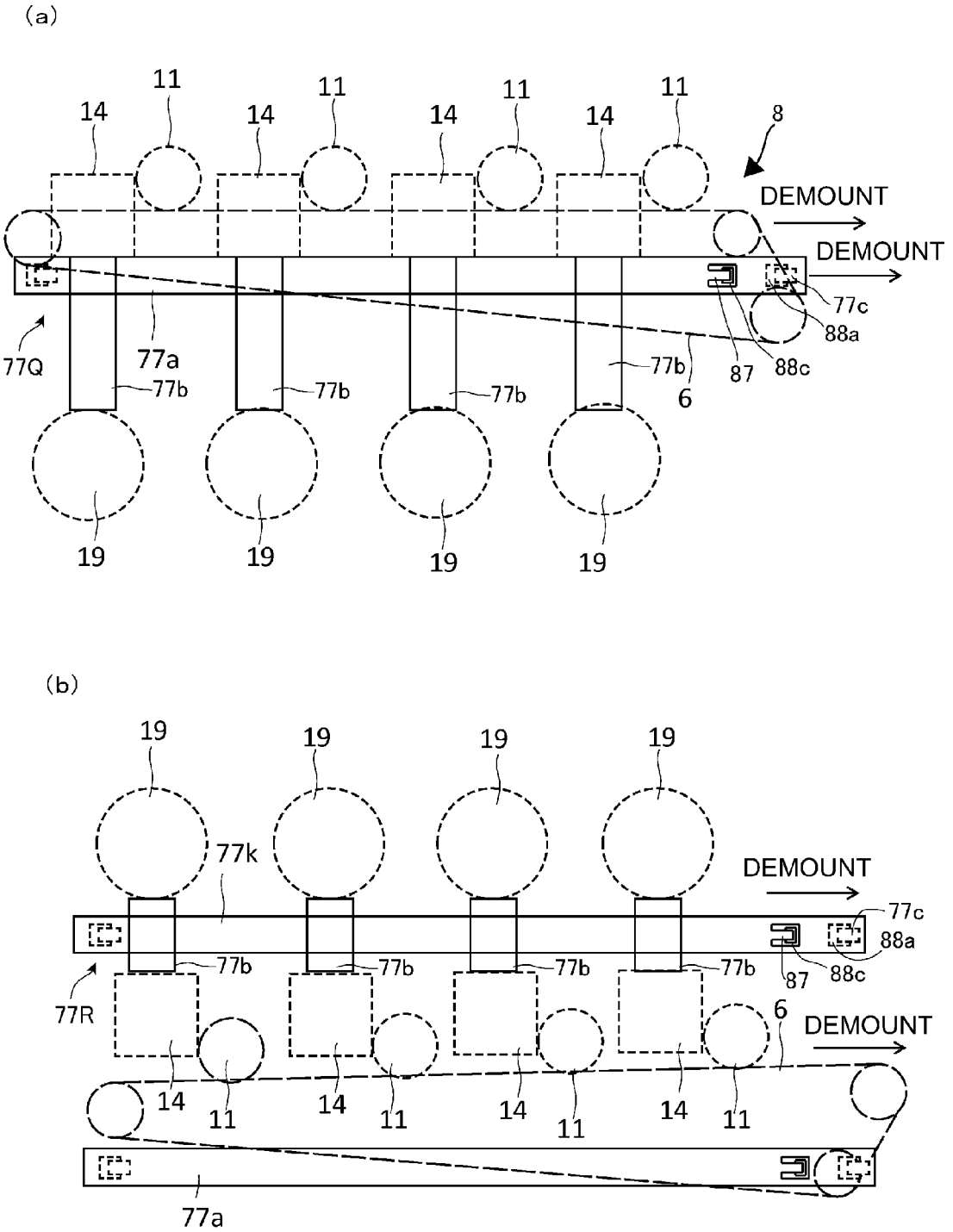

Parts (a) and (b) of FIG. 17 are illustrations of structures of image forming apparatuses in Embodiment 3 and Embodiment 4, respectively.

DESCRIPTION OF THE EMBODIMENTS

Embodiments of the present invention will be described specifically with reference to the drawings.

Embodiment 1

(Image Forming Apparatus)

Figure 1:
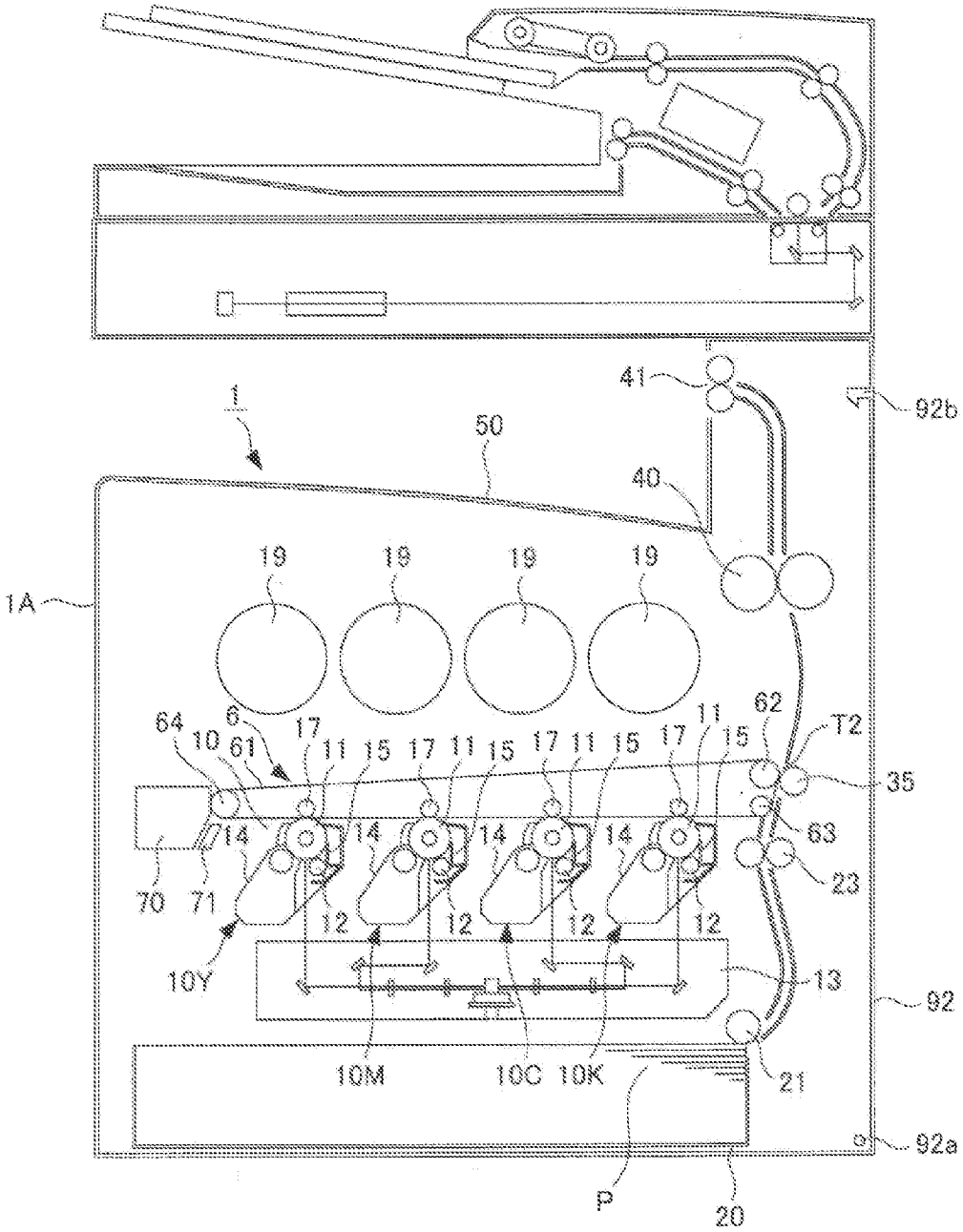
FIG. 1 is an illustration of a general structure of an image forming apparatus.

FIG. 1 is an illustration of a general structure of an image forming apparatus 1. As shown in FIG. 1, the image forming apparatus 1 is an intermediary transfer type full color printer of a tandem type in which image forming portions 10Y, 10M, 10C and 10K for yellow, magenta, cyan and black, respectively, are arranged along an intermediary transfer belt 61.

At the image forming portion 10Y, a yellow toner image is formed on a photosensitive drum 11(Y) and then is transferred onto the intermediary transfer belt 61. At the image forming portion 10M, a magenta toner image is formed on a photosensitive drum 11(M) and then is transferred onto the intermediary transfer belt 61. At the image forming portions 10C and 10K, cyan and black toner images are formed on photosensitive drums 11(C) and 11(K), respectively, and then are transferred onto the intermediary transfer belt 61.

A recording material P is pulled from a recording material cassette 20 and then is separated one by one by a separating roller 21. Then, the recording material P is in a stand-by state at a registration roller pair 23, and then is sent into a secondary transfer portion T2 by the registration roller pair 23. The four color toner images transferred on the intermediary transfer belt 61 are transferred onto the recording material P conveyed through the secondary transfer portion T2. The recording material P on which the toner images are transferred is pressed and heated by a fixing device 40, and then is, after being subjected to fixing of the toner images thereon, discharged onto a tray 50 by a discharging roller pair 41.

(Image Forming Portion)

The image forming portions 10Y, 10M, 10C and 10K have the same constitution except that colors of toners used in developing devices are different from each other. In the following, the image forming portion 10Y is described, and redundant explanation about the image forming portions 10M, 10C and 10K will be omitted.

The image forming portion 10Y includes, at a periphery of the photosensitive drum 11, a charging roller 12, an exposure device 13, a developing device 14, a primary transfer roller 17 and drum cleaning device 15. The photosensitive drum 11 includes an OPC photosensitive layer. The charging roller 12 electrically charges a surface of the photosensitive drum 11 to a negative potential uniformly. The exposure device 13 scans the surface of the photosensitive drum 11 with a laser beam through a rotating mirror, so that an electrostatic image is written (formed) on the photosensitive drum 11. The developing device 14 develops the electrostatic image with a two-component developer, so that the toner image is formed on the surface of the photosensitive drum 11.

The primary transfer roller 17 presses an inner surface of the intermediary transfer belt 61 to form a primary transfer portion between the photosensitive drum 11 and the intermediary transfer belt 61. By applying a positive DC voltage to the primary transfer roller 17, the toner image on the photosensitive drum 11 is primary-transferred onto the intermediary transfer belt 61.

The drum cleaning device 15 rubs the photosensitive drum 11 with a cleaning blade to collect a transfer residual toner remaining on the photosensitive drum 11 without being transferred onto the intermediary transfer belt 61. A belt cleaning device 70 rubs the intermediary transfer belt 61 with a cleaning blade 71 to collect a transfer residual toner from the intermediary transfer belt 61 having passed through the secondary transfer portion T2.

As shown in FIG. 1, toner cartridges 19 supply toners to the developing devices 14 through toner supply passages 77*b* (FIG. 9). The toner cartridges 19 filled with supply developers containing the toners of yellow, magenta, cyan and black, respectively, supply the color toners to the developing devices 14 of the image forming portions 10Y, 10M, 10C and 10K, respectively. Each of the toner cartridges 19 is rotated, and then the toner is taken out through a part of the toner cartridge 19 into an unshown hopper. The unshown hopper sends, to the toner supply passage 77*b*, the supply developer in an amount corresponding to a used amount of the toner of an associated color every image formation of a sheet by the image forming apparatus 1.

Parts (a) and (b) of FIG. 2 are sectional views for illustrating mounting and demounting of an intermediary transfer unit with respect to the image forming apparatus.

As shown in FIG. 1, an intermediary transfer unit 6 is mounted detachably by being pulled out from a casing 1A of the image forming apparatus 1 in a right direction. At a right side surface of the image forming apparatus 1, an openable door 92 capable of opening the casing 1A rightward is provided. The openable door 92 is shaft-supported by a lower-side rotation shaft 92*a* and is locked to the image forming apparatus 1 by an upper-side door-locking portion 92*b*.

As shown in (a) of FIG. 2, when lock of the door-locking portion 92*b* is released and then the openable door 92 is rotated about the rotation shaft 92*a*, the openable door 92 is opened. As shown in (b) of FIG. 2, the openable door 92 is opened and then the intermediary transfer unit 6 of a belt unit 80 is pulled out in an arrow B direction, so that the intermediary transfer unit 6 can be demounted from the casing 1A of the image forming apparatus 1.

FIG. 3 is a perspective view of the intermediary transfer unit. As shown in FIG. 1, the intermediary transfer belt 61 of the intermediary transfer unit 6 is stretched by a tension roller 64, a follower roller 63, a driving roller 62 and the four primary transfer rollers 17. The driving roller 62 also functioning as a secondary transfer inside roller and supports an inner surface of the intermediary transfer belt 61 at the secondary transfer portion T2, formed with registration roller 35. The driving roller 62 is rotationally driven by an unshown driving motor to rotate the intermediary transfer belt 61 at a predetermined process speed.

As shown in FIG. 3, the intermediary transfer unit 6 is provided with transfer frames 65 at side surfaces thereof. The transfer frames 65 support rotation shafts of the tension roller 64, the driving roller 62 and the four primary transfer roller 17 via bearings. In front and rear positions of the transfer frames 65 with respect to the rotational direction of the intermediary transfer belt 61, guiding projected-portions 6*a* and 6*b* for guiding and positioning the intermediary transfer unit 6 when the intermediary transfer unit 6 is inserted into the casing 1A of the image forming apparatus 1 are provided, respectively.

The intermediary transfer belt 61 is formed with a polyether ether ketone (PEEK) resin material in view of resistance to fatigue from flexing. The primary transfer roller 17 is prepared by disposing an electroconductive elastic layer on a surface of a center shaft formed of metal (e.g., stainless steel) in a diameter of 8 mm. As a material for the electroconductive elastic layer, EPDM (ethylene-propylene copolymer rubber), foamed urethane, and the like are used. The electroconductive elastic layer uniformly applies a high voltage to the surface of the intermediary transfer belt 61 contacted to the photosensitive drum 11 (FIG. 1).

(Casing)

FIG. 4 is an illustration of an inside structure of a casing of the image forming apparatus as seen from a front surface side. FIG. 5 is an illustration of the inside structure of the casing of the image forming apparatus as seen from a rear surface side.

As shown in FIG. 4, an inside space of the casing 1A of the image forming apparatus 1 is divided into upper and lower spaces, and a partition wall 8 is provided vertically. At a lower end of the vertical partition wall 8, a stay 82 constituting a horizontal floor surface is connected. On the stay 82, a laser scanner 13 is mounted.

Between a front wall 9 and the partition wall 8 of the casing 1A, the image forming portions 10Y, 10M, 10C and 10K are disposed. The image forming portions 10Y, 10M, 10C and 10K are hung and supported by unshown horizontal guide rails and are individually pullable out toward the front side.

As shown in FIG. 5, in a rear side of the partition wall 8, a driving unit 81 for driving the image forming portions 10Y, 10M, 10C and 10K and for rotational driving the intermediary transfer belt is mounted. The driving unit 81 includes a gear train for transmitting a driving force from a driving motor M11 to the photosensitive drum 11 and a gear train for transmitting the driving force from a driving motor M61 to the driving roller 62.

For this reason, in the case where rigidity of the partition wall 8 is low, there is a possibility that vibration of intermeshing pitch of gears constituted in the driving unit 81 vibrates the photosensitive drum 11 via the partition wall 8. Further, there is also a possibility that the vibration is transmitted from the partition wall 8 to the stay 82 to vibrate the exposure device 13. When the photosensitive drum 11 and the exposure device 13 are vibrated with a large amplitude, an output image is liable to cause image defect such as scanning line pitch non-uniformity.

Comparison Example

FIG. 6 is an illustration of an arrangement of a guiding member in a Comparison example. FIG. 7 is an illustration of an arrangement of toner supply passages in the Comparison example. FIG. 8 is a schematic view for illustrating the number of openings of a partition wall in the Comparison example.

As shown in FIG. 6, in the Comparison example, a guiding member 77*a* for supporting the intermediary transfer unit 6 so as to be pullable out from the casing 1A of the image forming apparatus 1 is provided on a surface of the partition wall 8 in an image forming apparatus side. The guiding member 77*a* is mounted to dedicated mounting holes provided at portions of the partition wall 8 on which the guiding member 77*a* is superposed (provided).

As shown in FIG. 7, in the Comparison example, the four toner supply passages 77*b* are disposed on a surface of the partition wall 8 in the rear surface side, i.e., on a surface of the partition wall 8 opposite from the side where the image forming portions 10Y, 10M, 10C and 10K are disposed. The four toner supply passages 77*b* individually supply the toners from the toner cartridges 19 to the 10Y, 10M, 10C and 10K disposed below the toner cartridges 19. The toner supply passages 77*b* are mounted to dedicated mounting holes provided at portions of the partition wall 8 on which the toner supply passages 77*b* is superposed. The toner supply passages 77*b* and the guiding member 77*a* are mounted separately at the rear surface and the front surface of the partition wall 8 so as not to interfere with each other.

As shown in FIG. 8, in this embodiment, in a region T of the partition wall 8, on opening K1 through which the toner cartridge 19 passes, opening K3 through which a developer supply port of the image forming portion 10Y passes, mounting holes K4 for fixing the toner supply passage 77*b*, and a mounting hole K2 for permitting mounting of the guiding member 77*a* are provided. For the single image forming portion 10Y, 7 to 8 mounting holes K4 are formed in the partition wall 8. In addition to the mounting holes K2 and K4 for permitting mounting of the guiding member 77*a* and the toner supply passage 77*b* which are provided singly, there is a need to provide the openings K1 and K3 for connecting the toner cartridge 19 and the image forming portion 10Y with the toner supply passage 77*b* in the rear side of the partition wall 8.

For this reason, in the Comparison example, when a thickness of a steel plate used as the partition wall 8 is made thin or when the materials for the toner supply passage 77*b* and the guiding member 77*a* are decreased in amount, the rigidity is lowered and thus mechanical vibration becomes large. As a result, the vibration is liable to be transmitted from advising source such as the driving gear train to the photosensitive drum 11 or the exposure device 13, so that the image defect such as the scanning line pitch non-uniformity is liable to occur. When the guiding member 77*a* is molded by using the material in a small amount, strength is lowered, so that a degree of deformation of the intermediary transfer unit 6 with the pulling-out of the intermediary transfer unit 6 becomes large.

Therefore, in Embodiment 1, the guiding member for the intermediary transfer unit 6 and the four toner supply passages are integrally assembled into an integrated member, and then the integrated member is disposed in the same surface side of the partition wall 8. As a result, not only image non-uniformity due to the lowering in rigidity of the partition wall 8 but also deformation of the guiding member when the intermediary transfer unit 8 is inserted and pulled are obviated.

Characteristic Portion of Embodiment 1

The plurality of image forming portions 10Y, 10M, 10C and 10K are disposed along the intermediary transfer belt 61, and the photosensitive drum 11 is an example of an individual image bearing member, the toner image is formable. The image forming portions 10Y, 10M, 10C and 10K are capable of being individually pulled out in a rotational axis direction of the photosensitive drums 11. The toner cartridges 19 are an example of a plurality of toner supply portions that supply the toners individually to the image forming portions 10Y, 10M, 10C and 10K.

In the intermediary transfer unit 6 is an example of a belt unit 80, the intermediary transfer belt 61 is the example of the belt member is stretched by, as examples of a plurality of rotatable supporting members, the driving roller 62, the tension roller 64 and the like. Between the image forming portions 10Y, 10M, 10C and 10K and the plurality of toner cartridges 19, a movement path by the guiding structure 77*a* for pulling out the intermediary transfer unit 6 is provided.

The partition wall 8 is an example of a partition wall member is a rear-side standing member for partitioning the space, in the casing, in which the intermediary transfer unit 6 is disposed. An integrally-molded member 77 as an example of the integrated member is superposed and fixed on the wall surface of the partition wall 8 in the side where the intermediary transfer unit 6 is disposed. At end portions of the guiding structure 77*a* with respect to a movement direction of the intermediary transfer unit 6, screw holes 77*h* and screws 188 are an example of a fixing structure for fixing the integrally-molded member 77 in the casing 1A.

The integrally-molded member 77 is prepared by integrally constituting the plurality of toner supply passages 77*b* and the single guiding structure 77*a* and is assembled with the casing 1A. The toner supply passage 77*b* permits communication of the image forming portion 10Y with the toner cartridge 19. The guiding structure 77*a* guides the intermediary transfer unit 6 so as to be moved in an arrangement direction of the plurality of image forming portions 10Y, 10M, 10C and 10K. The integrally-molded member 77 is formed by integrally molding, with a resin material, the plurality of toner supply passages 77*b* and the guiding structure 77*a*. An assembling portion for the integrally-molded member 77 in the casing 1A is molded with a material different from the resin material for the integrally-molded member 77.

(Integrally-Molded Member)

FIG. 9 is an illustration of a structure of the image forming apparatus in Embodiment 1. FIG. 10 is an illustration of an arrangement of an assembled structure of an integrated member. FIG. 11 is a perspective view of the integrated member. FIG. 12 is a schematic view for illustrating the number of openings of a partition wall in Embodiment 1.

As shown in FIG. 9, the integrally-molded member 77 is a resin-molded part obtained by integrally combining the guiding structure 77*a*, for guiding the intermediary transfer unit 6 during demounting from and mounting to the image forming apparatus, with the four toner supply passages 77*b* for the image forming portions 10Y, 10M, 10C and 10K. The integrally-molded member 77 is positioned and fixed on the inner surface of the partition wall 8.

As shown in FIG. 2, when the intermediary transfer unit 6 is moved along the guiding structure 77*a*, as shown in FIG. 3, the guiding projected-portions 6*a* and 6*b* provided on the transfer frames 65 in both sides of the intermediary transfer unit 6 rub a shelf-like upward surface of the guiding structure 77*a* shown in FIG. 9.

As shown in FIG. 10, the guiding structure 77*a* of the integrally-molded member 77 is a guide rail for guiding the intermediary transfer unit 6 demounted from and mounted to the image forming apparatus 1 while supporting the guiding projected portions 6*a* and 6*b* of the intermediary transfer unit 6. The intermediary transfer unit 6 is moved in a horizontal direction (X direction) along the partition wall 8 of the image forming apparatus 1, and therefore the guiding structure 77*a* is formed in a shape extending in the horizontal direction.

The toner supply passages 77*b* are four independent pipe passages through which the toners are to be supplied from the toner cartridges 19 to the image forming portions 10Y, 10M, 10C and 10K. The toner supply passages 77*b* supply the toners from above to below with respect to the vertical direction (Z direction), and therefore the toner supply passages 77*b* are formed in a shape extending in the substantially vertical direction.

As shown in FIG. 10, a mounting portion 77*c* which is a cylindrical projection projected and formed at a rear surface of the integrally-molded member 77 is engaged with a mounting hole 8*h* formed in the partition wall 8 to position the integrally-molded member 77 with respect to the X and Z directions. Further, by fastening the integrally-molded member 77 with a female thread formed on the partition wall 8 by inserting a screw 188 into a threaded hole formed in a bottom surface of the integrally-molded member 77, positioning of the integrally-molded member 77 with respect to Y direction is made. By three mounting portions 77*c* provided along the guiding structure 77*a*, positioning of the integrally-molded member 77 is made, and at two threaded holes 77*h* disposed at end portions of the guiding structure 77*a*, fixing of the integrally-molded member 77 to the partition wall 8 is realized.

As shown in FIG. 10, a lower end portion of the toner supply passage 77*b* is a boundary region where the toner supply passage 77*b* is connected with the developing device 14 of the image forming portion 10Y. For this reason, as shown in FIG. 11, at a supply port (surface) 77*d*, a supply shutter 78*d* urged in a direction (arrow C direction) in which the supply shutter 78 disclosed by a shutter spring 79*d*. The supply shutter 78*d* automatically closes the supply port 77*d* with movement of the image forming portion 10Y to be pulled out toward the front side, so that the toner is prevented from scattering into the inside of the casing 1A by drop thereof by gravitation.

As shown in FIG. 11, the integrally-molded member 77 is prepared by integrally molding, with ABS resin material, the guiding structure 77*a* for the intermediary transfer unit 6 and the four toner supply passages 77*b*. The integrally-molded member 77 is prepared by forming, as a unit, the guiding structure 77*a* extending in the substantially horizontal direction and the toner supply passage 77*b* extending in the substantially vertical direction, so that the rigidity of each of the guiding structure 77*a* and the toner supply passage 77*b* is made higher than the rigidity in the Comparison example. As shown in FIGS. 6 and 7, in the Comparison example, when the material used for the guiding structure 77*a* was decreased in amount, there was a possibility of insufficient rigidity. On the other hand, in Embodiment 1, the guiding structure 77*a* is reinforced by the four toner supply passages 77*b*, and therefore even when the amount of the use material is decreased, the integrally-molded member 77 having high rigidity is obtained.

As shown in FIG. 10, the integrally-molded member 77 has the high rigidity, and therefore the number of the mounting portions 77*c* can be decreased. It is enough that the mounting portions 77*c* are provided at three positions along the guiding structure 77*a*. When the number of the mounting portions 77*c* of the guiding structure 77*a* is small, the number of the mounting holes 8*h* of the partition wall 8 to be engaged with the guiding structure 77*a* can be decreased.

As shown in FIG. 12, in Embodiment 1, the number of the mounting holes 8*h* of the partition wall 8 may only be required to be small, and therefore the rigidity of the partition wall 8 becomes higher than the rigidity in the Comparison example shown in FIG. 8. Different from the Comparison example shown in FIG. 7, the toner cartridge 19 and the image forming portion 10Y are not connected with each other in the rear surface side of the partition wall 8, and therefore there is no need to provide not only the opening K1 (FIG. 8) through which the toner cartridge 19 is passed through the partition wall 8 but also the opening K3 (FIG. 8) through which the image forming portion 10Y is passed through the partition wall 8. In this embodiment, the toner supply passage 77*b* is provided in the front surface side of the partition wall 8, i.e., in the image forming portion side, and therefore the partition wall 8 is not required to be provided with the opening K1 (FIG. 8) for permitting passing of the image forming portion 10Y. For that reason, there is no particular need to provide the partition wall 8 with many holes, so that the rigidity of the partition wall 8 is higher than that in Comparison example. When the rigidity of the partition wall 8 is high, vibration of the image forming portion 10Y and the exposure device 13 becomes small, so that the image defect resulting from the scanning line pitch non-uniformity of the output image is prevented.

As shown in FIG. 11, the toner supply passage 77*c* is supported at the rear surface thereof by the partition wall 8 in close contact with the partition wall 8, and therefore the supply port 77*d* is prevented from being obliquely inclined due to bending of the toner supply passage 77*c* at the lower end portion toward the rear surface side by an urging force of the shutter spring 79*d*. For that reason, the toner is prevented from leaking out through a gap formed between the supply port 77*d* and a bonding portion in the image forming portion 10Y side by the oblique inclination. Thus, the toner supply passage 77*c* causes no contamination with the toner in the casing generated by misregistration (misalignment) between the toner supply passage 77*c* and the supply port of the developing device of the image forming apparatus 10Y. Such a problem is obviated by a combination of the integrally-molded member 77 having the rigidity with the partition wall 8 having the rigidity.

Embodiment 2

FIG. 13 is an illustration of an assembled state of an integrated member in Embodiment 2. Parts (a) and (b) of FIG. 14 are schematic views for illustrating a relationship between a mounting portion and a positioning opening. FIG. 15 is a schematic view for illustrating a relationship between a hook portion and the positioning opening. Parts (a) and (b) of FIG. 16 are schematic views for illustrating a demounting and mounting method of an integrated member.

An integrally-molded member in this embodiment is constituted in the same manner as the integrally-molded member in Embodiment 1 except for a mounting structure to the partition wall, and is positioned and fixed in the same position in the same image forming apparatus. For this reason, in FIGS. 13 to 16, constituent elements common to Embodiments 1 and 2 are represented by the same reference numerals or symbols as those in FIGS. 1 to 12 will be omitted from redundant description.

As shown in FIG. 14, a plurality of holes 88*a* as an example of an engaging opening are formed at a portion where the partition wall 8 overlaps with the integrally-molded member 77. A plurality of mounting portions 77*c* as an example of an engaging structure are engaged with the plurality of holes 88*a*, respectively, by moving the integrally-molded member 77 in a predetermined direction in a contact state with the partition wall 8.

As shown in FIG. 15, a hole 88*c* as an example of a positioning opening is formed at a portion where the partition wall 8 overlaps with the integrally-molded member 77 (guiding structure 77*a*). A hook portion 87 as an example of a lock structure is urged toward the partition wall 8 by a spring, and is engaged with the hole 88*c* in a process in which the integrally-molded member 77 is moved in the predetermined direction, thus limiting movement of the integrally-molded member 77 in the predetermined direction. The hook portion 87 is capable of manually eliminate engagement thereof with the hole 88*c* in a space where the intermediary transfer unit 6 is disposed. The hook portion 87 is capable of manually eliminating the engagement thereof with the hole 88*c* through a casing opening for permitting pulling-out of the intermediary transfer unit 6 from the casing 1A.

As shown in FIG. 13, the integrally-molded member 77 is positioned and fixed on the front-side surface of the partition wall 8 as a rear-side inner wall. As shown in FIG. 13, the mounting portions 77*c* are disposed at end portions of the integrally-molded member 77, and the hook portion 87 is disposed at one of the end portions of the integrally-molded member 77. The mounting portions 77*c* are engaged with the engaging openings 88*a* of the partition wall 8 to mount the integrally-molded member 77 on the partition wall 8. The hook portion 87 drops into the positioning opening 88*c* to position the integrally-molded member 77 in a predetermined position.

As shown in (a) of FIG. 14, Z direction (vertical direction) of the integrally-molded member 77 is determined by the mounting portion 77*c* and the engaging opening 88*c* of the partition wall 8.

As shown in (b) of FIG. 14, Y direction of the integrally-molded member 77 is determined by constraining an edge of the engaging opening 88*a* of the partition wall 8 by a hooking portion 77*j* of the mounting portion 77*c*. The integrally-molded member 77 is, after the mounting portion 77*b* is inserted into the engaging opening 88*a* of the partition wall 8, mounted to the partition wall 8 being slid in −X direction.

As shown in FIG. 15, X direction of the integrally-molded member 77 is determined by abutment of the hook portion 87 against an edge of the positioning opening 88*c* of the partition wall 8. The hook portion 87 has an elastic snap-fit structure and thus is elastically deformable in an arrow F direction about a center E. The integrally-molded member 77 is positioned and fixed in a predetermined position on the partition wall 8.

As shown in (a) of FIG. 16, the hook portion 87 is in a state in which the openable door 92 is open, present in an accessible region from a side surface side of the image forming apparatus 1.

As shown in (b) of FIG. 16, in the state in which the openable door 92 is open, the snap-fit structure of the hook portion 87 is elastically deformed to eliminate the limitation of the integrally-molded member 77 in X direction, and when the integrally-molded member 77 is slid and moved in the arrow B direction, the integrally-molded member 77 can be demounted.

As shown in FIG. 7, in the Comparison example, during execution of maintenance of the inside of the image forming apparatus, a service person, carries out toner cleaning in the toner supply passage 77*b*, thus preventing a problem of toner clogging. When the maintenance is carried out, the service person accesses the toner supply passage 77*b* by demounting many parts to clean the inside of the toner supply passage 77*b*.

As shown in FIG. 16, on the other hand, in Embodiment 2, by opening the openable door 92, the service person is accessible to the hook portion 87 of the integrally-molded member 77, and therefore the integrated toner supply passages 77*b* for the four colors can be demounted to the outside of the image forming apparatus 1 at one time. For this reason, a maintenance property is improved.

Embodiments 3 and 4

Parts (a) and (b) of FIG. 17 are illustrations of structures of image forming apparatuses in Embodiment 3 and Embodiment 4, respectively. As shown in FIG. 1, in Embodiments 1 and 2, the embodiments of the image forming apparatus in which the toners were supplied from the upper toner cartridges 19 into the lower developing devices 14 which were disposed so as to sandwich the intermediary transfer unit 6 was described. However, the present invention can also be carried out in an arrangement embodiment in which the toner supply portions and the image forming portions are separately provided.

As shown in (a) of FIG. 17, in Embodiment 3, the supply develops are moved upward from lower toner cartridges 19 to upper developing devices 14 through toner supply passages 77*b*. The four toner supply passages 77*b* are caused to integrally communicate with each other by the guiding structure 77*a* similarly as in Embodiment 1 to constitute an integrally-molded member 77Q. As shown in (a) of FIG. 17 with reference to FIG. 14, the integrally-molded member 77Q is in close contact with the partition wall 8 by engaging a mounting portion 77*c* of the integrally-molded member 77Q with an edge of an engaging opening 88*a* of the partition wall 8. As shown in (a) of FIG. 14 with reference to FIG. 15, a hook portion 87 of the integrally-molded member 77Q has a snap-fit structure in which the hook portion 87 drops into a positioning opening 88*c* of the partition wall 8 to limit movement of the mounting portion 77*c* in an engagement-eliminating direction.

As shown in (b) of FIG. 17, in Embodiment 4, an integrally-molded member 77R as an example of the integrally-molded member is integrally molded, with a resin material, with a plurality of toner supply passages 77*b* for permitting communication of the plurality of toner cartridges 19 with the plurality of image forming portions 10Y, 10M, 10C and 10K individually. The integrally-molded member 77R includes a plurality of mounting portions 77*c* and a hook portion 87. The plurality of mounting portions are engaged with a plurality of holes 88*a*, respectively, formed in the partition wall 8. The hook portion 87 is engaged with a hole 88*c* of the partition wall 8 to limit movement of the integrally-molded member 77R in a direction in which the engagement of the mounting portions 77*c* is eliminated. The hook portion 87 is capable of eliminating the limitation of the movement of the integrally-molded member 77R by being manually operated from a side where the image forming portions 10Y, 10M, 10C and 10K are disposed on the partition wall 8.

The integrally-molded member 77R is constituted by collectively molding, with the resin material, the four toner supply passages 77*b* as a unit by a dedicated reinforcing portion 77*k* independent from the guiding structure 77*a*. The integrally-molded member 77R is in close contact with the partition wall 8 by engaging a mounting portion 77*c* thereof with an edge of an edge of an engaging opening 88*a* of the partition wall 8. A hook portion 87 of the integrally-molded member 77R has a snap-fit structure such that the hook portion 87 drops into a positioning opening 88*c* of the partition wall 8 to limit movement of the mounting portion 77*c* in an engagement-eliminating direction.

The above-described embodiments can also be carried out in other embodiments in which a part or all of constituent elements are replaced with their alternative constituent elements so long as the plurality of toner supply passages are assembled into a single part and are detachably mountable to the casing as a unit.

Therefore, the belt member is not limited to the intermediary transfer belt but may also be a recording material conveying belt or a transfer belt. The image forming apparatus can be carried out irrespective of the number of the image bearing members, a charging type of the image bearing members, a type of formation of the electrostatic image, the developer and a developing type, a transfer type, and the like. Further, by adding necessary devices, equipment and casing structures and the like, the present invention can be carried out in image forming apparatuses of various uses, such as printers, various printing machines, copying machines, facsimile machines, and multi-function machines.

In the image forming apparatus in the present invention, the plurality of toner supply passages are assembled in the single part as the integrally-molded member by using the belt unit guiding structure disposed so as to cross the plurality of toner supply passages. For this reason, positioning of the belt unit guiding structure relative to the casing and positioning of the plurality of the toner supply passages relative to the casing can be achieved simultaneously by a single positioning operation. Accordingly, the belt unit guiding structure can be disposed so as not to constitute an obstacle to the disposition of the toner supply passages and at the same time, the individual resin-molded products are not required to be positionally fixed.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 281068/2012 filed Dec. 25, 2012, which is hereby incorporated by reference.

What is claimed is:

1. An image forming apparatus comprising:

a main assembly;

a belt unit, including a belt member and a plurality of supporting rollers for supporting said belt member, detachably mountable to said main assembly with respect to a direction crossing a rotational axis direction of said supporting rollers;

a plurality of image forming portions, provided below said belt unit along said belt member, for forming toner images on said belt member;

a plurality of toner cartridges, provided above said belt unit, for supplying toners to said plurality of image forming portions, respectively;

a side plate provided in said main assembly; and an integrated member provided on said side plate and including a guiding member having a guiding portion for guiding said belt unit and a plurality of toner supply passages for permitting communication of said image forming portions with said toner cartridges associated with said image forming portions, respectively, wherein said guiding member and said toner supply passages are integrally constituted so that said toner supply passages penetrate said guiding member.

2. An image forming apparatus according to claim 1, wherein said guiding member and said toner supply passages of said integrated member are integrally molded with a resin material.

3. An image forming apparatus according to claim 1, wherein said guiding member and said toner supply passages of said integrated member are fixed by bonding or a connecting member.

4. An image forming apparatus according to claim 1, wherein a cross-sectional shape of said guiding member of said integrated member in a plane perpendicular to rotation shafts of said supporting rollers is a U shape.

5. An image forming apparatus according to claim 4, wherein said integrated member is supported by said side plate in close contact with said side plate at a rear surface portion of said guiding member having the U shape.

6. An image forming apparatus according to claim 1, wherein said integrated member is integrally detachably mountable to said side plate.

7. An image forming apparatus according to claim 1, wherein each of said toner supply passages of said integrated member extends in a substantially vertical direction.

8. An image forming apparatus according to claim 1, wherein said belt unit includes a frame for supporting said supporting rollers, and wherein said guiding portion of said integrated member extends in a substantially horizontal direction, and when said belt unit is demounted from and mounted to said main assembly, said belt unit is guided by engaging a guiding projection portion, provided on said frame, with said guiding portion.

9. An image forming apparatus according to claim 1, further comprising, at a lower end portion of each of said toner supply passages of said integrated member, a shutter member for preventing the toner from falling into said main assembly when said image forming portions are pulled out from said main assembly.

10. An image forming apparatus according to claim 1, further comprising a driving source, provided in an opposite side of said side plate to a side where said belt unit is mounted, for providing a driving force to said belt unit.

11. An image forming apparatus according to claim 1, wherein in a region where said integrated member is provided on said side plate, a hole is provided in which an assembling portion of said integrated member is engaged, and wherein said integrated member is positioned and fixed to said side plate by being slid and moved in a substantially horizontal direction in a state in which the assembling portion is engaged in the hole.

12. An image forming apparatus according to claim 1, wherein said toner cartridges are insertable and pullable with respect to the rotational axis direction of said supporting rollers.

13. An image forming apparatus according to claim 1, wherein said side plate is formed of metal.

14. An image forming apparatus according to claim 1, wherein an assembling portion of said integrated member is formed of a material different from a material for a portion other than the assembling portion.

15. An image forming apparatus comprising:

a main assembly;

a plurality of image forming portions, provided so as to be independently pullable toward a front surface side of said main assembly, for forming toner images on a plurality of image forming members, respectively;

a plurality of toner supply portions for supplying toners to said plurality of image forming portions, respectively;

a side plate provided in said main assembly; and an integrated member obtained by integrally molding, with a resin material, a plurality of toner supply passages for permitting communication of said image forming portions with said toner supply passages, respectively, wherein said integrated member includes a plurality of engaging portions engaged with a plurality of engaging openings, respectively, provided in said side plate and includes a lock member for limiting movement of said integrated member in a direction in which engagement of said engaging openings with said engaging portions is eliminated, and wherein said lock member is capable of eliminating limitation of the movement of said integrated member by being manually operated from a side, of said side plate, where said image forming portions are provided.

* * * * *